US008205882B2

(12) United States Patent
Kato

(10) Patent No.: US 8,205,882 B2
(45) Date of Patent: Jun. 26, 2012

(54) RECORDING APPARATUS

(75) Inventor: Shigeki Kato, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 278 days.

(21) Appl. No.: 12/699,459

(22) Filed: Feb. 3, 2010

(65) Prior Publication Data

US 2010/0230890 A1 Sep. 16, 2010

(30) Foreign Application Priority Data

Mar. 10, 2009 (JP) ..... 2009-055947

(51) Int. Cl.
*B65H 5/02* (2006.01)

(52) U.S. Cl. ..... 271/275; 271/193; 271/198

(58) Field of Classification Search ..... 271/275, 271/193, 198
See application file for complete search history.

(56) References Cited

U.S. PATENT DOCUMENTS

| | | | | |
|---|---|---|---|---|
| 3,584,733 | A * | 6/1971 | Isermann | 198/691 |
| 5,821,968 | A | 10/1998 | Ohyama et al. | |
| 7,832,853 | B2 * | 11/2010 | Nakashima | 347/104 |

FOREIGN PATENT DOCUMENTS

| | | | |
|---|---|---|---|
| EP | 0693381 | A1 | 1/1996 |
| JP | H07-133035 | A | 5/1995 |
| JP | H07-330185 | A | 12/1995 |
| JP | 2007-119223 | A | 5/2007 |

OTHER PUBLICATIONS

Japan Patent Office; Notification of Reason(s) for Refusal for Patent Application No. 2009-055947, dispatched Jan. 18, 2011. (counterpart to above-captioned U.S. patent application).

* cited by examiner

*Primary Examiner* — David H Bollinger
(74) *Attorney, Agent, or Firm* — Baker Botts L.L.P.

(57) ABSTRACT

A recording apparatus for forming an image on a recording medium, including: a recording head; a conveyor belt to convey the medium in a conveyance direction; an attraction device including a first electrode having first extending portions and a second electrode having second extending portions and configured to permit the belt to generate an attractive force to attract the medium to the belt by giving mutually different potentials to the first and second electrodes; and, a pressing device including a contact member having electrical conductivity and disposed at a position where the contact member is opposed to respective upstream sections of the first and second extending portions, which upstream sections are located on an upstream side of the head in the conveyance direction, the contact member being configured to contact the medium placed on the belt, the pressing device being configured to press the medium onto the belt by the contact member.

12 Claims, 6 Drawing Sheets

RECORDING APPARATUS

CROSS REFERENCE TO RELATED APPLICATION

The present application claims priority from Japanese Patent Application No. 2009-055947, which was filed on Mar. 10, 2009, the disclosure of which is herein incorporated by reference in its entirety.

BACKGROUND OF THE INVENTION

1. Field of the Invention

The present invention relates to a recording apparatus configured to form an image on a recording medium.

2. Discussion of Related Art

There is known an ink-jet printer including: a conveyer belt wound around three rollers, i.e., a drive roller, a driven roller, and a tension roller; a convey roller which is biased toward the driven roller and which is configured to convey a sheet (a recording medium) while cooperating with the conveyer belt to sandwich the sheet therebetween; and an electrostatic-attractive-force generating means which is disposed between the drive roller and the driven roller and which is configured to permit the conveyor belt to generate an electrostatic attractive force.

In the above-described ink-jet printer, the electrostatic-attractive-force generating means includes two electrodes, i.e., an electrode plate and an earth electrode plate each having a comb-like shape and is configured to permit the conveyor belt to generate the electrostatic attractive force by application of a voltage between the two plates. The sheet sandwiched by the conveyor belt and the convey roller is conveyed to a region at which the sheet is opposed to a recording head while being attracted to the conveyor belt by the electrostatic attractive force, and an image is formed on the sheet by the recording head.

SUMMARY OF THE INVENTION

In the ink-jet printer described above, because the convey roller is disposed upstream of the electrostatic-attractive-force generating means, the sheet is not attracted to the conveyor belt while being pressed onto the conveyor belt. In other words, the sheet is not attracted, at a portion thereof that is pressed by the convey roller, to the conveyor belt by the electrostatic-attractive-force generating means. The attractive force by the electrostatic-attractive-force generating means is not large enough to attract the sheet floating above the conveyor belt. In other words, the sheet that is being separating from the conveyor belt cannot be sufficiently attracted by the attractive force. Further, in an instance where a clearance is generated between the sheet and the conveyor belt, the clearance functions as a large electric resistance, resulting in a reduction in the electric current that flows from the electrode plate to the sheet through the conveyor belt and flows from the sheet to the earth electrode plate through the conveyor belt. A Johnsen-Rahbeck force (attractive force) that acts between the conveyor belt and the sheet decreases with a decrease in the electric current that passes between the conveyor belt and the sheet. In other words, the attractive force decreases with a decrease in the electric current, causing instability in the sheet conveyance.

It is therefore an object of the invention to provide a recording apparatus which is capable of increasing an attractive force by which a recording medium is attracted to the conveyor belt.

The above-indicated object of the invention may be achieved according to a principle of the invention, which provides a recording apparatus, comprising:

- a recording head configured to form an image on a recording medium;
- a conveyor belt configured to convey the recording medium placed thereon in a medium conveyance direction with the recording medium opposed to the recording head;
- an attraction device which is disposed at a position where the conveyor belt is interposed between the attraction device and the recording head and which includes (a) a first electrode having a plurality of first extending portions each of which extends so as to be longer than the recording head in the medium conveyance direction and (b) a second electrode having a plurality of second extending portions each of which extends so as to be longer than the recording head in the medium conveyance direction, each of the plurality of first extending portions and each of the plurality of second extending portions being alternately arranged in a perpendicular direction that is perpendicular to the medium conveyance direction, the attraction device being configured to permit the conveyor belt to generate an attractive force to attract the recording medium to the conveyor belt by giving mutually different potentials to the first electrode and the second electrode; and,
- a pressing device including a contact member which has electrical conductivity and which is disposed at a position where the contact member is opposed to respective upstream sections of the plurality of first extending portions and the plurality of second extending portions, which sections are located on an upstream side of the recording head in the medium conveyance direction, the contact member being configured to contact the recording medium placed on the conveyor belt, the pressing device being configured to press the recording medium onto the conveyor belt by the contact member.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENT

There will be hereinafter described a preferred embodiment of the invention with reference to the drawings.

Figure 1:
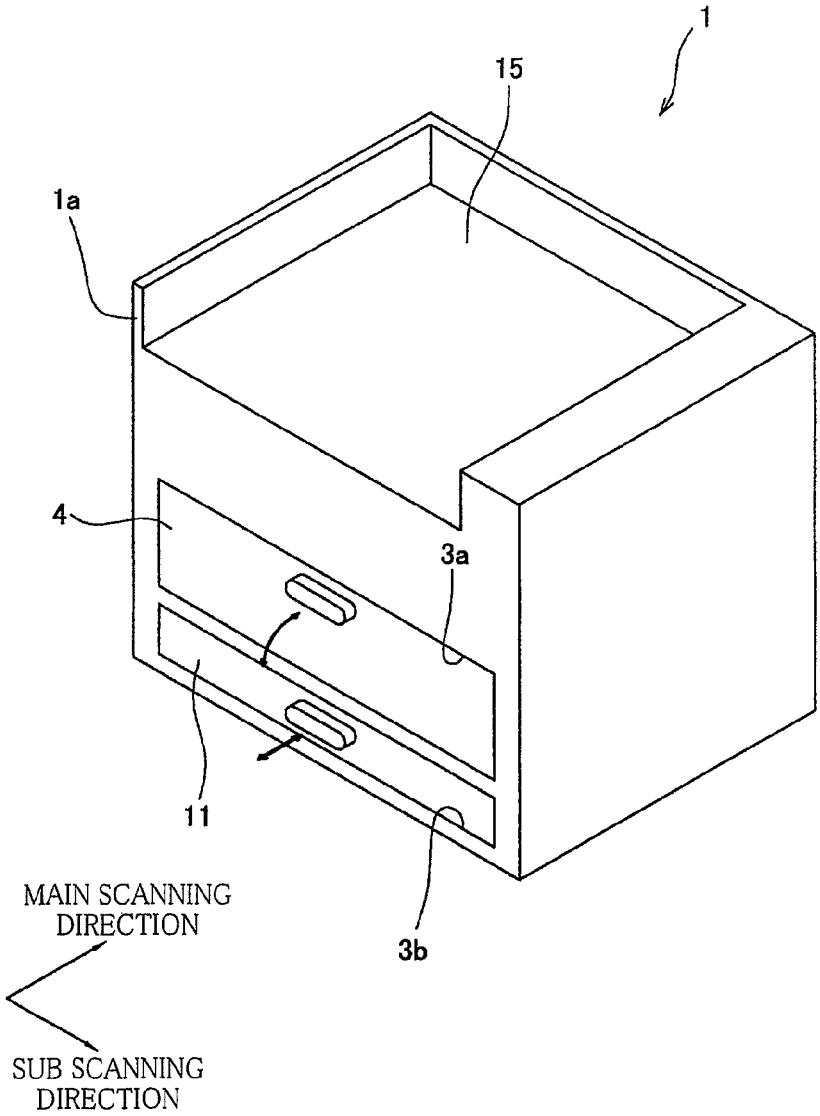
FIG. 1 is a perspective external view of an ink-jet printer according to one embodiment of the invention.

As shown in the perspective view of FIG. 1, an ink-jet printer 1 as a recording apparatus according to the invention has a casing 1*a* which is a rectangular parallelepiped and which has two openings, i.e., upper and lower openings 3*a*, 3*b*, that are formed on the front of the casing 1*a* (on the front surface of the casing 1*a* in FIG. 1). In the opening 3*a*, a door 4 is provided so as to be openable and closable about a horizontal axis located at the lower end of the opening 3*a*. The opening 3*a* and the door 4 are disposed so as to be opposed to a conveyor unit 50 in a depth direction of the casing 1*a*, namely, in a direction perpendicular to the sheet plane of FIG. 2, i.e., in a main scanning direction. In the structure, in an instance where a sheet P (as a recording medium) is jammed on the conveyor unit 50, the user opens the door 4 and the conveyor unit 50 is moved downward by an up/down moving mechanism (not shown), so that a jammed sheet P can be removed.

Figure 2:
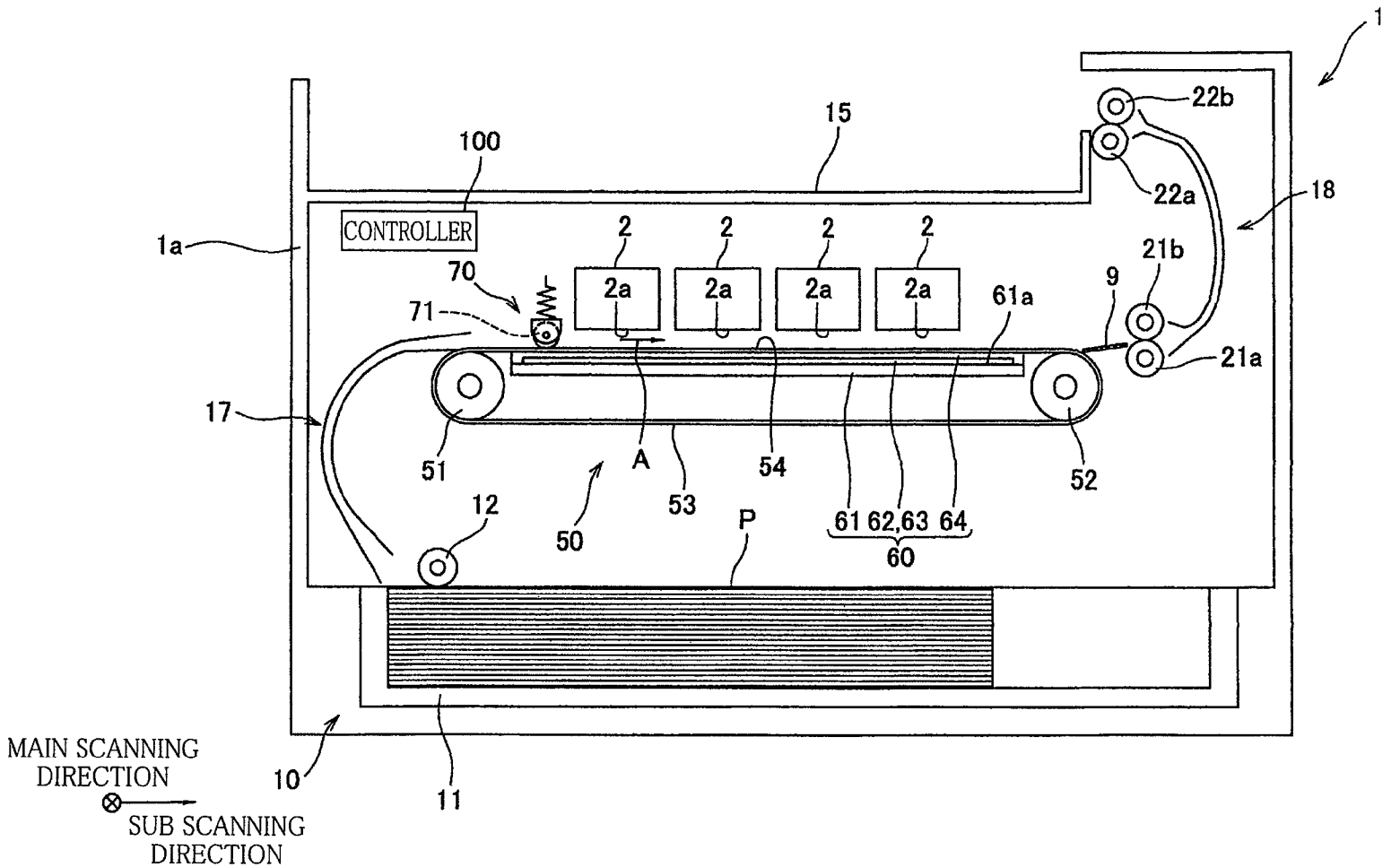
FIG. 2 is a schematic view showing an internal structure of the ink-jet printer of FIG. 1.

As shown in FIG. 2, the ink-jet printer 1 is a color ink-jet printer having four ink-jet heads 2 which respectively eject inks of different colors, i.e., magenta, cyan, yellow, and black. The printer 1 has a sheet supply unit 10 at its lower portion and a discharged sheet receiving portion 15 at its upper portion. The conveyor unit 50 for conveying the sheet P in a sheet conveyance direction A as a medium conveyance direction is disposed between the sheet supply unit 10 and the discharged-sheet receiving portion 15. The printer 1 further has a controller 100 for controlling operations thereof.

Each of the four ink-jet heads 2 has a generally rectangular parallelepiped shape that is long in the main scanning direction. The four ink-jet heads 2 are arranged in a sub scanning direction. That is, the ink-jet printer 1 is a line-type printer. In the present embodiment, the sub scanning direction is a direction parallel to the sheet conveyance direction A in which the sheet P is conveyed while the main scanning direction is a direction perpendicular to the sub scanning direction and is horizontal, namely, the main scanning direction coincides with the vertical direction in FIG. 3.

Each ink-jet head 2 has a laminar body having: a flow-passage unit in which are formed ink passages that include pressure chambers; and an actuator for giving pressure to the ink in the pressure chambers. The flow-passage unit and the actuator (both not shown) are bonded to each other so as to provide the laminar body. The bottom surface of each ink-jet head 2 is formed as an ejection surface 2*a* from which the ink is ejected. In the ejection surface 2*a*, there are formed a plurality of ejection openings (not shown) through which the ink is ejected. The ejection surface 2*a* has a dimension as measured in the main scanning direction that is slightly larger than the dimension of the sheet P as measured in the same direction. Accordingly, it is possible to form an image over the entire surface of the sheet P, namely, it is possible to conduct marginless printing.

As shown in FIG. 2, the sheet supply unit 10 includes a sheet cassette 11 in which a stack of sheets P can be accommodated, a sheet supply roller 12 configured to supply an uppermost one of the sheets P from the sheet cassette 11, and a sheet supply motor (not shown) configured to rotate the sheet supply roller 12. The sheet cassette 11 is disposed so as to be attachable to and detachable from the casing 1*a* through the opening 3*b* in a direction perpendicular to the sheet plane of FIG. 2. In a state in which the sheet cassette 11 is installed on the casing 1*a*, the sheet cassette 11 overlaps the conveyor unit 50 when viewed from the top of the printer 1.

The sheet supply roller 12 is configured to supply the uppermost one of the sheets P from the sheet cassette 11 while being held in rolling contact therewith. The sheet supply motor is controlled by the controller 100. On the left side of the sheet cassette 11 as seen in FIG. 2, there is disposed a sheet guide 17 which extends in a curved form from the sheet cassette 11 toward the conveyor unit 50.

In the structure described above, the sheet supply roller 12 is rotated clockwise in FIG. 2 by being controlled by the controller 100, whereby the sheet P contacting the sheet supply roller 12 is supplied to the conveyor unit 50 through the sheet guide 17.

The conveyor unit 50 includes two belt rollers 51, 52, an endless conveyor belt 53 that is wound around the two belt rollers 51, 52 so as to be stretched therebetween, a conveyance motor (not shown) configured to rotate the belt roller 52 under the control of the controller 100, and an attraction device 60. The two belt rollers 51, 52 are arranged side by side in the sheet conveyance direction A.

The conveyor belt 53 is formed of polyimide or fluororesin, for instance, and has flexibility and volume resistivity of about $10^8$-$10^{14}$ Ùcm. The conveyor belt 53 may be formed of any other material provided that the material permits the conveyor belt 53 to have the flexibility and the volume resistivity described above.

As shown in FIG. 2, the attraction device 60 is disposed in a region enclosed by the conveyor belt 53 and includes a plate-like base member 61 which is formed of an insulating material and which has a flat upper surface 61*a*, two electrodes 62, 63 bonded to the upper surface 61*a*, and a protective film 64 bonded to the upper surface 61*a* so as to cover the entirety of the electrodes 62, 63.

The base member 61 is disposed so as to be opposed to the four ink-jet heads 2. The length of the base member 61 as measured in the sub scanning direction is made larger than a distance between an upstream end portion of the most upstream one of the ink-jet heads 2 and a downstream end portion of the most downstream one of the ink-jet heads 2, in the sheet conveyance direction A. Further, the dimension of the base member 61 as measured in the main scanning direction is made substantially equal to the dimension of the belt rollers 51, 52 as measured in the main scanning direction.

Figure 3:
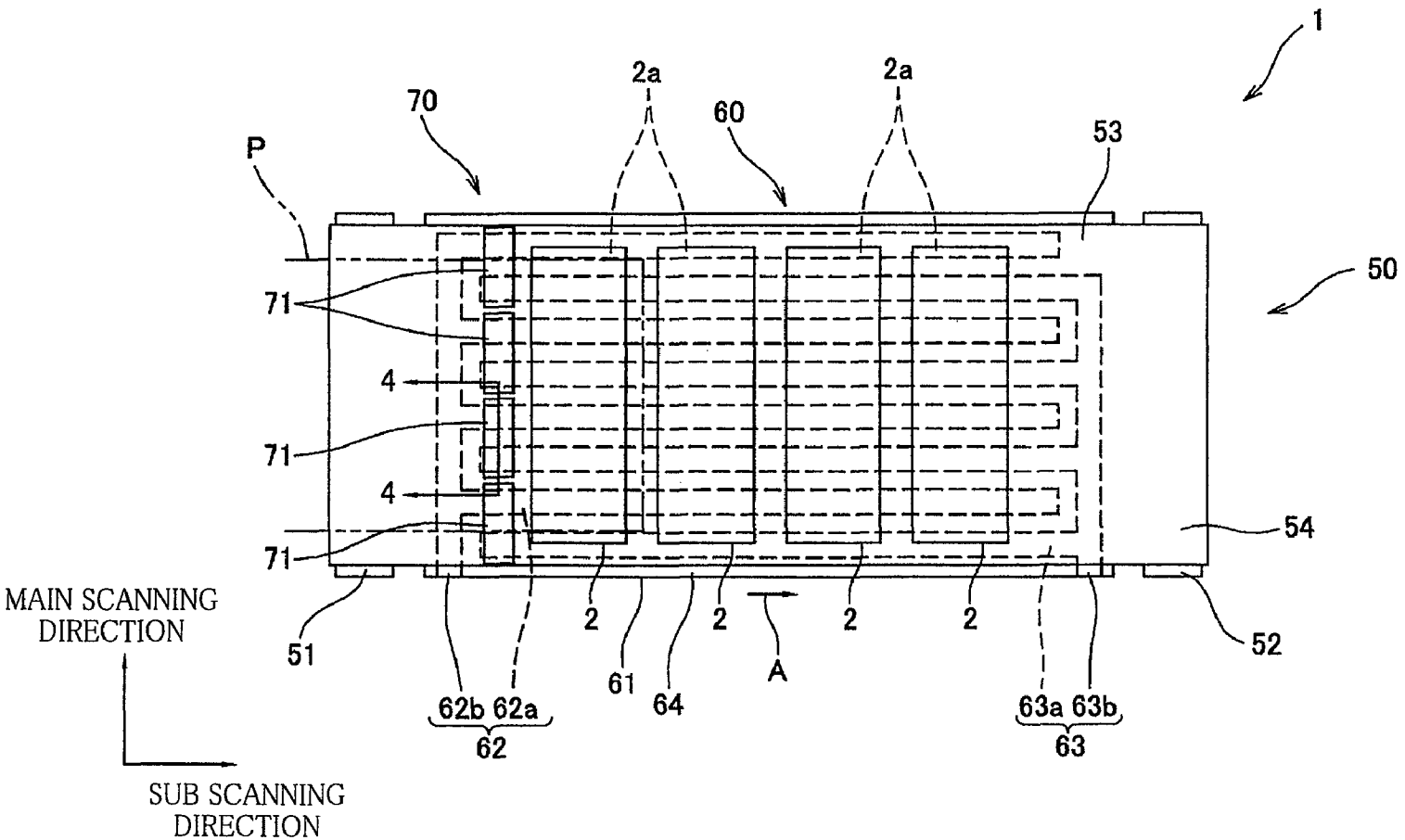
FIG. 3 is a plan view showing four ink-jet heads of FIG. 2 and the vicinity thereof when viewed from the above.

As shown in FIG. 3, the electrode 62 as a first electrode includes four extending portions 62*a* each as a first extending portion that extend in the sheet conveyance direction A and a connecting portion 62*b* as a first connecting portion that extends in the main scanning direction so as to connect the extending portions 62*a*. The electrode 62 has a comb-like shape as shown in FIG. 3. Each extending portion 62*a* is disposed such that its upstream end is located upstream of the most upstream ink-jet head 2 while its downstream end is located downstream of the most downstream ink-jet head 2, in the sheet conveyance direction A. In other words, each extending portion 62*a* has a length as measured in the sub scanning direction that is larger than the distance between the upstream end portion of the most upstream ink-jet head 2 and the downstream end portion of the most downstream ink-jet head 2, in the sheet conveyance direction A. The connecting portion 62*b* is disposed upstream of the most upstream ink-jet head 2 in the sheet conveyance direction A.

Like the electrode 62, the electrode 63 as a second electrode includes four extending portions 63*a* each as a second extending portion that extend in the sheet conveyance direction A and a connecting portion 63*b* as a second connecting portion that extends in the main scanning direction so as to connect the extending portions 63*a*. The electrode 63 has a comb-like shape as shown in FIG. 3. Each of the four extending portions 63*a* of the electrode 63 and each of the four extending portions 62*a* of the electrode 62 are alternately arranged in the main scanning direction as shown in FIG. 3. The connecting portion 63*b* is disposed downstream of the most downstream ink-jet head 2 in the sheet conveyance direction A. The connecting portions 62*b*, 63*b* of the respective two electrodes 62, 63 are connected to a power source, not shown, that is controlled by the controller 100.

The protective film 64 is formed of polyimide or fluororesin, for instance, and has volume resistivity of about $10^8$-$10^{14}$ Ùcm. The protective film 64 may be formed of any other material provided that the material permits the protective film 64 to have the volume resistivity described above. The attraction device 60 is located at a position where the protective film 64 is in contact with the inner circumferential surface of the upper loop portion of the conveyor belt 53, so as to support the conveyor belt 53 from the inside of the loop of the belt 53. According to the arrangement, the conveyor surface 54 at the upper loop portion of the conveyor belt 53 and the ejection surfaces 2*a* of the ink-jet heads 2 are opposed to each other so as to be parallel to each other, and there is formed a slight clearance between the ejection surfaces 2*a* and the conveyor surface 54 of the conveyor belt 53. The clearance constitutes a part of a sheet transfer or conveyance path through which the sheet P is transferred or conveyed.

Figure 4:
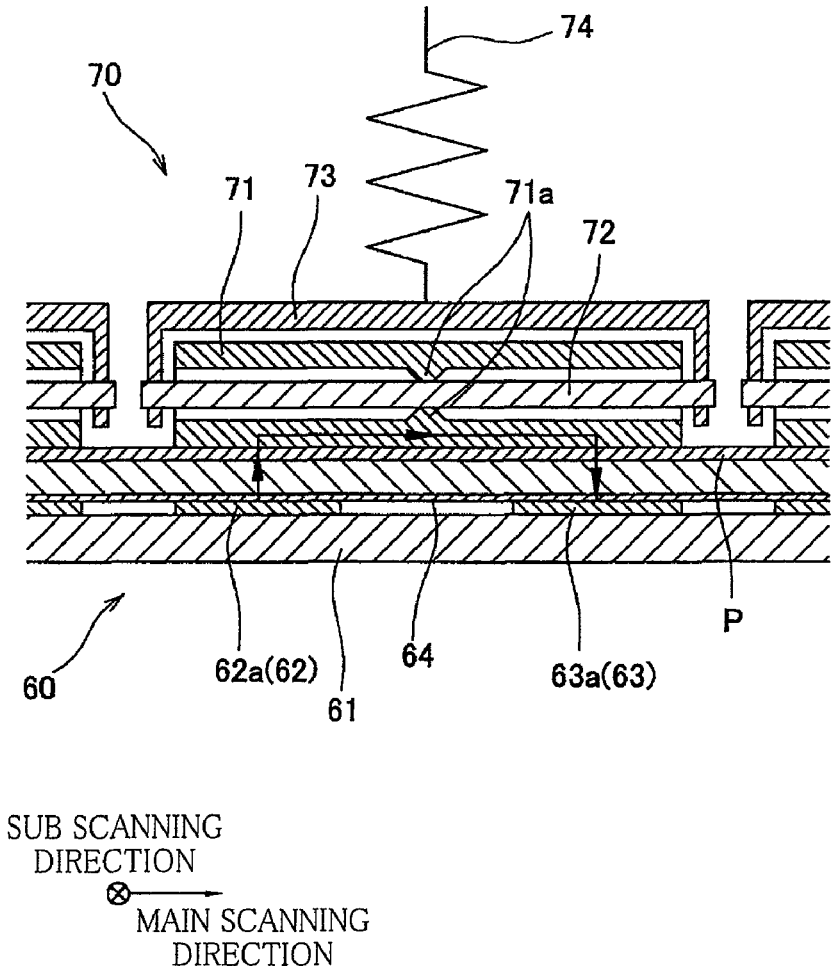
FIG. 4 is a cross sectional view taken along line 4-4 in FIG. 3.

As shown in FIGS. 2-4, a pressing mechanism 70 as a pressing device configured to press the sheet P onto the conveyor surface 54 is disposed at a position which is upstream of the most upstream ink-jet head 2 in the sheet conveyance direction A and at which the pressing mechanism 70 is opposed to the upstream sections of the respective extending portions 62*a*, 63*a*. The pressing mechanism 70 includes four pressing units each consisting of a roller 71, a shaft member 72 which, rotatably supports the roller 71, a support member 73 which supports the shaft member 72, and a biasing member 74 which biases the roller 71 toward the conveyor belt 53. The four pressing units are arranged in the main scanning direction. That is, the pressing mechanism 70 includes four rollers 71, four shaft members 72, four support members 73, and four biasing members 74. More specifically, the rollers 71 each as a contact member are disposed so as to be opposed to the upstream sections of the respective extending portions 62*a*, 63*a*.

Each roller 71 is formed of electrically conductive aluminum, for instance. The roller 71 may be formed of any other material provided that the material permits the roller 71 to have electric conductivity. As shown in FIG. 4, the roller 71 has a cylindrical shape. An annular protrusion 71*a* is formed at the axially central portion of the inner circumferential surface of each roller 71, so as to extend toward the shaft member 72. The apex of the annular protrusion 71*a* and the outer circumferential surface of the shaft member 72 are in contact with each other such that the roller 71 is rotatably supported with respect to the shaft member 72 as a support shaft. In other words, the roller 71 is supported by the shaft member 72 that defines an axis which is parallel to a direction perpendicular to the sheet conveyance direction A and about which the roller 71 is rotatable. Between the inner circumferential surface of the roller 71 except the axially central portion thereof at which the annular protrusion 71*a* is formed and the outer circumferential surface of the shaft member 72, a suitable clearance is formed. In the arrangement, the roller 71 can be diametrically movable or pivotable with respect to the shaft member 72 about the apex of the annular protrusion 71*a* as the pivot center. In other words, the above-described clearance is made smaller at the axially central portion of the inner circumferential surface of the roller 71 than the other portion thereof by provision of the annular protrusion 71*a*, and the roller 71 is permitted to be inclined or pivoted, to a certain degree corresponding to the clearance, about the pivot center that corresponds to a point at which the clearance is made smaller. Each roller 71 has a length as measured in the main scanning direction that permits the roller 71 to bridge a corresponding one of the first extending portions 62*a* and a corresponding one of the second extending portions 63*a* that are adjacent to each other in the main scanning direction. Accordingly, the sheet P can be effectively pressed onto the conveyor belt 53.

Each of the four biasing members 74 constituting a biasing mechanism is formed of an elastic member such as a spring and is provided on the central portion of the upper surface of the corresponding support member 73. According to the arrangement, the rollers 71 can be biased toward the conveyor belt 53 independently of each other by the respective biasing members 74, so that the sheet P can be effectively pressed onto the conveyor belt 53.

In the structure described above, the belt roller 52 is rotated clockwise in FIG. 2 under the control of the controller 100, whereby the conveyor belt 53 is moved or rotated. On this occasion, the belt roller 51 and the four rollers 71 are also rotated in accordance with the rotary movement of the conveyor belt 53. In the present arrangement, each roller 71 is configured to be diametrically movable with respect to the corresponding shaft member 72, as explained above. Accordingly, even though the roller 71 is installed with its center axis slightly inclined in the main scanning direction, for instance, the roller 71 rotates while inclining or moving such that the center axis coincides with the main scanning direction, in accordance with the rotary movement of the conveyor belt 53. Therefore, when the sheet P is conveyed while being held by and between the four rollers 71 and the conveyor belt 53, the sheet P is hard to skew with respect to the sheet conveyance direction A.

Further, on this occasion, there are given, under the control of the controller 100, mutually different potentials to the two electrodes 62, 63, namely, a positive or negative potential is given to the electrode 62 while a ground potential is given to the electrode 63. The potential given to the electrode 62 is 1 kV, for instance. When the potentials are thus given to the respective two electrodes 62, 63, the electric current flows as indicated by the arrows in FIG. 4 at a portion of the conveyor belt 53 that is opposed to the four rollers 71, because the rollers 71 are electrically conductive. That is, the electric current flows from the electrode 62 (the extending portions 62*a*) to the roller 71 through the protective film 64, the conveyor belt 53, and the sheet P and flows from the roller 71 to the electrode 63 (the extending portions 63*a*) through the sheet P, the conveyor belt 53, and the protective film 64, and positive or negative electric charge is generated at a part of the conveyor belt 53 facing the sheet P while electric charge whose polarity is opposite to that of the above-indicated electric charge is induced on the surface of the sheet P facing the conveyor belt 53. The electric charge generated on the conveyor belt 53 and the electric charge generated on the sheet P are attracted to each other, whereby there is generated the attractive force by which the sheet P is attracted to the conveyor belt 53.

On the other hand, at the other portion of the conveyor belt 53 that is not opposed to the four rollers 71, the electric current flows from the electrode 62 (the extending portions 62*a*) to the sheet P through the protective film 64 and the conveyor belt 53 and flows from the sheet P to the electrode 63 (the extending portions 63*a*) through the conveyor belt 53 and the protective film 64. The resistance value of the sheet P in this instance is considerably larger than that of each roller 71. Accordingly, the overall resistance value in this current path is larger than the overall resistance value in the current path that passes through each roller 71. Therefore, even though the same potentials are given to the respective electrodes 62, 63, the current value becomes larger in an instance where the current path passes through the roller 71 than in an instance, where the current path does not pass through the roller 71. In this respect, the Johnsen-Rahbeck force that acts between the conveyor belt 53 and the sheet P, namely, the attractive force by the attraction device 60, increases with an increase in the electric current flowing between the conveyor belt 53 and the sheet P. Accordingly, the attractive force is larger at the portion of the conveyor belt 53 opposed to the four rollers 71 than the other portion thereof, owing to the increased electric current.

The sheet P supplied from the sheet supply unit 10 is initially attracted to the conveyor surface 54 at the portion of the conveyor belt 53 at which the attractive force is considerably large as described above (i.e., at the portion opposed to the four rollers 71), and is subsequently conveyed in the sheet conveyance direction A while being held by or attracted to the conveyor surface 54 at the other portion of the conveyor belt 53 (i.e., the other portion not opposed to the four rollers 71). When the sheet P conveyed by the conveyor belt 53 while being attracted to the conveyor surface 54 of the conveyor belt 53 passes right below the four ink-jet heads 2, the ink-jet heads 2 controlled by the controller 100 eject the respective different colors of inks toward the sheet P, so that a desired color image is formed on the sheet P.

A separation member 9 is disposed on the immediately downstream side of the conveyor unit 50 in the sheet conveyance direction A. The separation member 9 is configured to separate the sheet P from the conveyor surface 54 such that the edge of the separation member 9 is inserted between the sheet P and the conveyor belt 53. At a time point when the leading end of the sheet P reaches the separation member 9, the attractive force between the conveyor surface 54 and the leading end of the sheet P has weakened, so that the sheet P is separated from the conveyor surface 54 by the separation member 9.

At a portion of the sheet transfer path between the conveyor unit 50 and the discharged-sheet receiving portion 15, there are disposed: four feed rollers 21*a*, 21*b*, 22*a*, 22*b*; and a sheet guide 18 located between the feed rollers 21*a*, 21*b* and the feed rollers 22*a*, 22*b*. The feed rollers 21*b*, 22*b* are rotatably driven by a feed motor (not shown) controlled by the controller 100. In the arrangement described above, the feed rollers 21*b*, 22*b* are rotated under the control of the controller 100, whereby the sheet P conveyed by the conveyor unit 50 is transferred upward in FIG. 2 through the sheet guide 18 while being held by the feed rollers 21*a*, 21*b*. Subsequently, the sheet P is transferred to the discharged-sheet receiving portion 15 while being held by the feed rollers 22*a*, 22*b*. The feed rollers 21*a*, 22*a* are driven rollers configured to be rotated as the sheet is transferred.

As explained above, in the ink-jet printer 1 according to the present embodiment, in an instance where the mutually different potentials are given to the two electrodes 62, 63 when the sheet P is conveyed to the portion of the conveyor belt 53 opposed to the pressing mechanism 70, the electric current value flowing through the two electrodes 62, 63 is larger at that portion than the other position as described above, whereby the attractive force by the attraction device 60 increases. Accordingly, before the leading end of the sheet P reaches the region at which the sheet P is opposed to the ink-jet heads 2, the sheet P can be attracted to the conveyor surface 54 at the portion of the conveyor belt 53 where the attractive force is large. Further, the sheet P is not only simply pressed onto the conveyor surface 54 by the rollers 71, but also undergoes the large attractive force, so that the leading end of the sheet P can be attracted to the conveyor surface 54 with high reliability. Accordingly, it is possible to suppress a jam of the sheet P during its conveyance due to collision of the leading end of the sheet P with the side surface of any of the ink-jet heads 2. In this regard, since the attractive force acts on not only the leading end of the sheet P, but also the entirety of the sheet P, it is possible to suppress floating of the central portion and the trailing end portion of the sheet P above the conveyor surface 54. Moreover, while the sheet P is attracted to the conveyor surface 54 by the large attractive force as described above, the sheet P can be attracted to the conveyor surface 54 also by the attractive force at the other portion of the conveyor belt 53 not opposed to the pressing mechanism 70 of the attraction device 60. Accordingly, the attraction efficiency is enhanced at the other portion, so that the attractive force by the attraction device 60 can be enhanced throughout the sheet P.

Since the pressing mechanism 70 includes the plurality of rollers 71, the sheet P can be effectively pressed onto the conveyor surface 54, as compared with an arrangement in which the sheet P is pressed onto the conveyor surface 54 by a single long roller. That is, even if there exists a variation in the diameter of the rollers 71 in the main scanning direction, the sheet P can be pressed onto the conveyor surface 54 without being largely influenced by the variation owing to the provision of the plurality of rollers 71.

Figure 5:
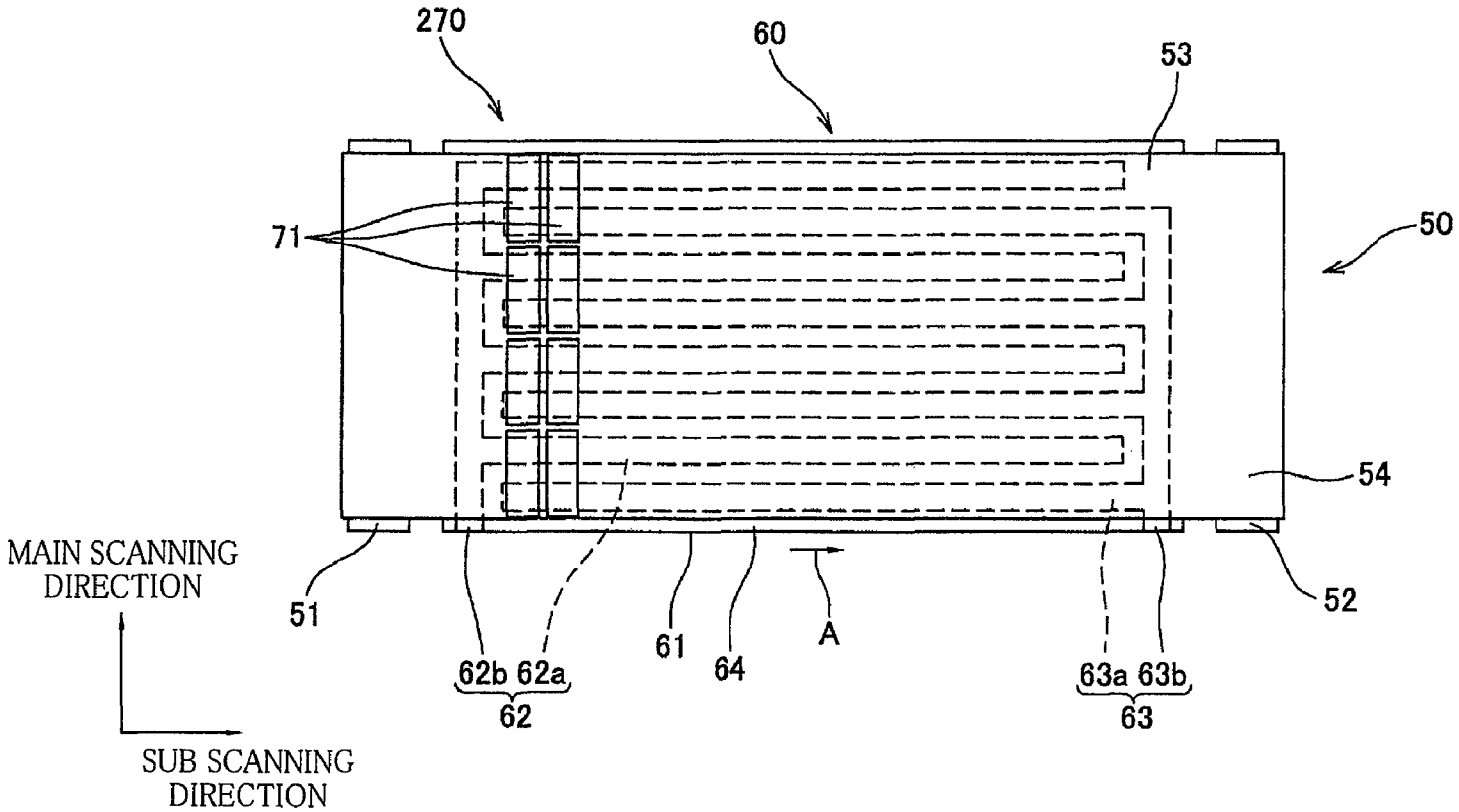
FIG. 5 shows a pressing mechanism according to a modified embodiment of the invention and is a plan view of a conveyor unit and the pressing mechanism when viewed from the above.

In the present embodiment, the pressing mechanism 70 includes the four rollers 71 arranged in a row in the main scanning direction. The pressing mechanism may be otherwise constructed. For instance, as shown in a first modified embodiment of FIG. 5, a pressing mechanism 270 has eight rollers 71 arranged in two rows. That is, the plurality of rollers 71 may be arranged in matrix. According to the first modified embodiment, the number of the portions at which the sheet P is pressed onto the conveyor surface 54 are increased in the sheet conveyance direction A, and the first modified embodiment ensures an increase in the number of the portions at which is generated the larger attractive force by the attraction device 60 to attract the sheet P to the conveyor surface 54.

Figure 6:
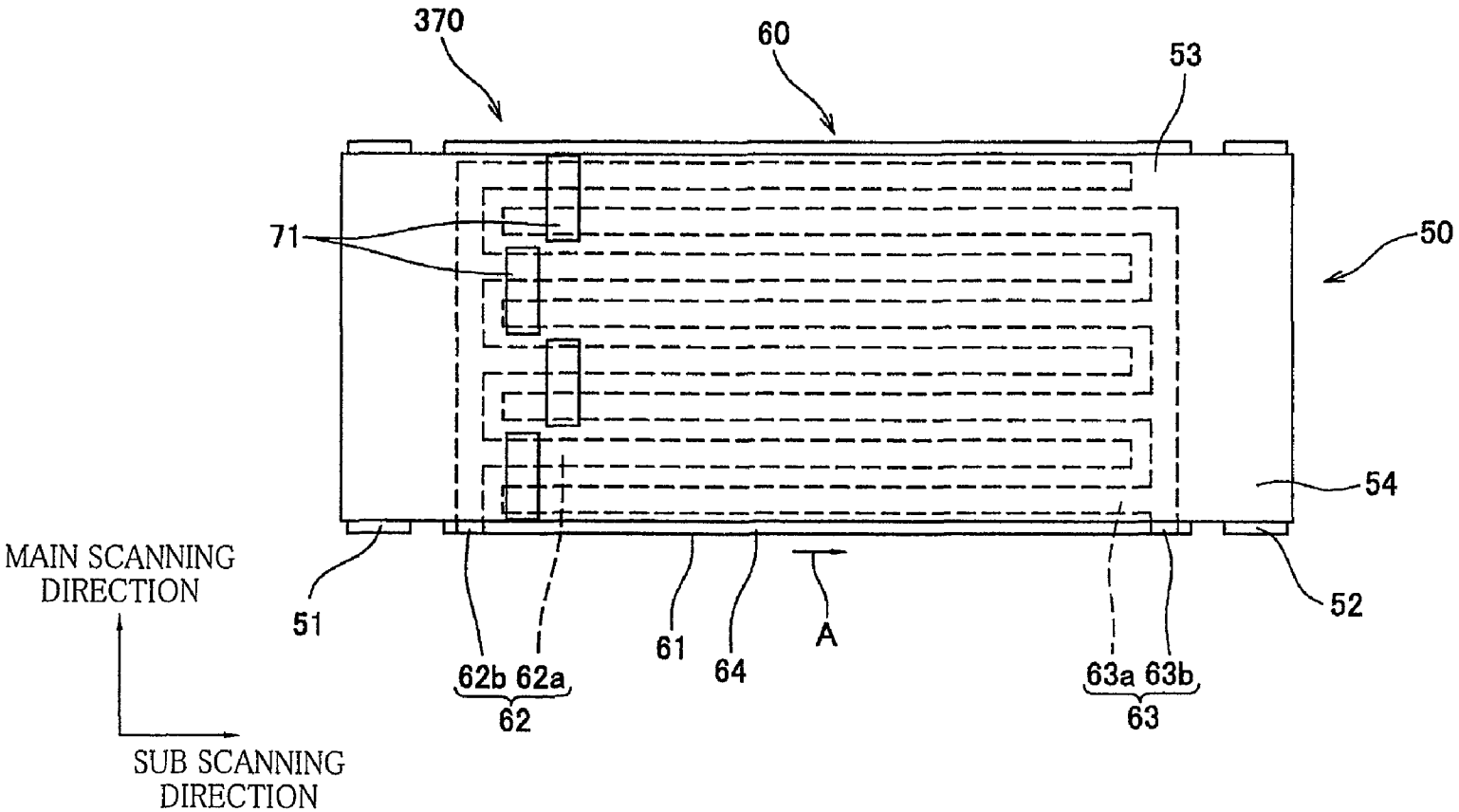
FIG. 6 shows a pressing mechanism according to another modified embodiment of the invention and is a plan view of the conveyor unit and the pressing mechanism when viewed from the above.

FIG. 6 shows a pressing mechanism 370 according to a second modified embodiment. The pressing mechanism 370 includes for rollers 71 that are arranged in a zigzag fashion in the main scanning direction. According to the second modified embodiment, the distance between any two rollers 71 that are adjacent to each other in the main scanning direction can be made large, whereby the plurality of rollers 71 can be easily disposed.

While the preferred embodiment of the invention and the modifications thereof have been described by reference to the accompanying drawings, it is to be understood that the invention is not limited to the details of the illustrated embodiment and its modifications, but may be embodied with various changes and modifications, which may occur to those skilled in the art, without departing from the scope of the invention defined in the attached claims. In the illustrated embodiment and the modified two embodiments, the pressing mechanisms 70, 270, 370 include the plurality of rollers 71. Each pressing mechanism may include, in place of the rollers 71, a pressing member which is configured not to be rotatable and which has a curved convex shape that protrudes toward the conveyor surface, at a portion thereof that is to come into contact with the conveyor surface and the sheet. Further, the pressing mechanism 70 may include one long roller, in place of the four rollers 71. Moreover, the pressing mechanism may have a structure in which the plurality of rollers 71 are supported by a single common shaft member. In this instance, only one biasing member may be provided on the support member that supports the shaft member. The clearance that permits the roller 71 to be movable or inclined with respect to the shaft member 72 may not be formed between the shaft member 72 and the roller 71.

The electrodes 62, 63 may not have the connecting portions 62*b*, 63*b*. In this case, each of the extending portions 62*a*, and each of the extending portions 63*a* may be directly connected to the power source. The ground potential may be given to the electrode 62 while the positive or negative potential may be given to the electrode 63. Further, one of the positive and negative potentials may be given to the electrode 62 while the other of the positive and negative potential may be given to the electrode 63. The principle of the invention may be applicable to any other recording apparatus that employ recording heads other than the ink-jet head.

What is claimed is:

1. A recording apparatus, comprising:

a recording head configured to form an image on a recording medium;

a conveyor belt configured to convey the recording medium placed thereon in a medium conveyance direction with the recording medium opposed to the recording head;

an attraction device which is disposed at a position where the conveyor belt is interposed between the attraction device and the recording head and which includes (a) a first electrode having a plurality of first extending portions each of which extends so as to be longer than the recording head in the medium conveyance direction and (b) a second electrode having a plurality of second extending portions each of which extends so as to be longer than the recording head in the medium conveyance direction, each of the plurality of first extending portions and each of the plurality of second extending portions being alternately arranged in a perpendicular direction that is perpendicular to the medium conveyance direction, the attraction device being configured to permit the conveyor belt to generate an attractive force to attract the recording medium to the conveyor belt by giving mutually different potentials to the first electrode and the second electrode; and, a pressing device including a contact member which has electrical conductivity and which is disposed at a position where the contact member is opposed to respective upstream sections of the plurality of first extending portions and the plurality of second extending portions, which sections are located on an upstream side of the recording head in the medium conveyance direction, the contact member being configured to contact the recording medium placed on the conveyor belt, the pressing device being configured to press the recording medium onto the conveyor belt by the contact member, wherein the contact member extends in the perpendicular direction so as to bridge over at least any adjacent two of the plurality of first extending portions and the plurality of second extending portions.

2. The recording apparatus according to claim 1, wherein the pressing device includes, as the contact member, a roller which is rotatably supported about an axis that is parallel to the perpendicular direction and which is to come into contact with the recording medium placed on the conveyor belt, at an outer circumferential surface thereof.

3. The recording apparatus according to claim 2, wherein the pressing device includes a biasing mechanism configured to bias the roller toward the conveyor belt.

4. The recording apparatus according to claim 1, comprising a plurality of recording heads, each as the recording head, which are arranged in the medium conveyance direction, wherein the contact member is disposed at a position where the contact member is opposed to the respective upstream sections of the plurality of first extending portions and the plurality of second extending portions, which upstream sections are located on an upstream side of the most upstream one of the plurality of recording heads in the medium conveyance direction.

5. A recording apparatus, comprising:

a recording head configured to form an image on a recording medium;

a conveyor belt configured to convey the recording medium placed thereon in a medium conveyance direction with the recording medium opposed to the recording head;

an attraction device which is disposed at a position where the conveyor belt is interposed between the attraction device and the recording head and which includes (a) a first electrode having a plurality of first extending portions each of which extends so as to be longer than the recording head in the medium conveyance direction and (b) a second electrode having a plurality of second extending portions each of which extends so as to be longer than the recording head in the medium conveyance direction, each of the plurality of first extending portions and each of the plurality of second extending portions being alternately arranged in a perpendicular direction that is perpendicular to the medium conveyance direction, the attraction device being configured to permit the conveyor belt to generate an attractive force to attract the recording medium to the conveyor belt by giving mutually different potentials to the first electrode and the second electrode; and, a pressing device including a contact member which has electrical conductivity and which is disposed at a position where the contact member is opposed to respective upstream sections of the plurality of first extending portions and the plurality of second extending portions, which sections are located on an upstream side of the recording head in the medium conveyance direction, the contact member being configured to contact the recording medium placed on the conveyor belt, the pressing device being configured to press the recording medium onto the conveyor belt by the contact member, wherein the pressing device includes, as the contact member, a roller which is rotatably supported about an axis that is parallel to the perpendicular direction and which is to come into contact with the recording medium placed on the conveyor belt, at an outer circumferential surface thereof, and wherein the pressing device is configured to permit inclination of the roller with respect to the axis.

6. The recording apparatus according to claim 5, wherein the roller has a hollow cylindrical shape, and the pressing device includes a support shaft that defines the axis and that supports the roller while being inserted in the roller, and wherein the pressing device is configured to permit the inclination of the roller by a clearance that is formed between an inner circumferential surface of the roller and an outer circumferential surface of the support shaft.

7. The recording apparatus according to claim 6, wherein the clearance is made smaller at a central portion of the roller in a direction of extension of the axis than at the other portion of the roller by an annular protrusion that is formed on one of the outer circumferential surface of the support shaft and the inner circumferential surface of the roller, and wherein the pressing device is configured to permit the inclination of the roller by an arrangement in which is permitted a pivotal movement of the roller about a pivot center that corresponds to a point at which the clearance is made smaller.

8. A recording apparatus, comprising:

a recording head configured to form an image on a recording medium;

a conveyor belt configured to convey the recording medium placed thereon in a medium conveyance direction with the recording medium opposed to the recording head;

an attraction device which is disposed at a position where the conveyor belt is interposed between the attraction device and the recording head and which includes (a) a first electrode having a plurality of first extending portions each of which extends so as to be longer than the recording head in the medium conveyance direction and (b) a second electrode having a plurality of second extending portions each of which extends so as to be longer than the recording head in the medium conveyance direction, each of the plurality of first extending portions and each of the plurality of second extending portions being alternately arranged in a perpendicular direction that is perpendicular to the medium conveyance direction, the attraction device being configured to permit the conveyor belt to generate an attractive force to attract the recording medium to the conveyor belt by giving mutually different potentials to the first electrode and the second electrode; and, a pressing device including a contact member which has electrical conductivity and which is disposed at a position where the contact member is opposed to respective upstream sections of the plurality of first extending portions and the plurality of second extending portions, which sections are located on an upstream side of the recording head in the medium conveyance direction, the contact member being configured to contact the recording medium placed on the conveyor belt, the pressing device being configured to press the recording medium onto the conveyor belt by the contact member, wherein the pressing device includes a plurality of rollers, each as the contact member, each of which is rotatably supported about an axis that is parallel to the perpendicular direction and each of which is to come into contact with the recording medium placed on the conveyor belt, at an outer circumferential surface thereof, the plurality of rollers being arranged in the perpendicular direction, each of the plurality of rollers bridging over a corresponding one of the plurality of first extending portions and a corresponding one of the plurality of second extending portions that are adjacent to each other.

9. The recording apparatus according to claim 8, wherein the pressing device includes a plurality of biasing mechanisms configured to respectively bias the plurality of rollers independently of each other toward the conveyor belt.

10. The recording apparatus according to claim 8, wherein the plurality of rollers are arranged in matrix.

11. The recording apparatus according to claim 8, wherein the plurality of rollers are arranged so as to form a plurality of rows in the medium conveyance direction.

12. The recording apparatus according to claim 8, wherein the plurality of rollers are arranged in a zigzag fashion.

* * * * *